US012139357B2

(12) United States Patent
Yang et al.

(10) Patent No.: US 12,139,357 B2
(45) Date of Patent: Nov. 12, 2024

(54) MATERIAL STRIP PROCESSING SYSTEM

(71) Applicants: Tyco Electronics (Shanghai) Co. Ltd, Shanghai (CN); TE Connectivity Services GmbH, Schaffhausen (CH)

(72) Inventors: An (Joshua) Yang, Shanghai (CN); Lvhai (Samuel) Hu, Shanghai (CN); Roberto Francisco-Yi Lu, Bellevue, WA (US)

(73) Assignees: Tyco Electronics (Shanghai) Co., Ltd., Shanghai (CN); TE Connectivity Solutions GmbH, Schaffhausen (CH)

( * ) Notice: Subject to any disclaimer, the term of this patent is extended or adjusted under 35 U.S.C. 154(b) by 342 days.

(21) Appl. No.: 17/692,747

(22) Filed: Mar. 11, 2022

(65) Prior Publication Data

US 2022/0289510 A1 Sep. 15, 2022

(30) Foreign Application Priority Data

Mar. 11, 2021 (CN) ..... 202110266138.6

(51) Int. Cl.

| | |
|---|---|
| ***B65H 19/30*** | (2006.01) |
| ***B65H 18/02*** | (2006.01) |
| ***B65H 18/04*** | (2006.01) |
| ***B65H 18/08*** | (2006.01) |
| ***B65H 19/22*** | (2006.01) |

(52) U.S. Cl.

CPC ..... *B65H 19/223* (2013.01); *B65H 18/021* (2013.01); *B65H 18/04* (2013.01); *B65H 18/08* (2013.01); *B65H 19/2292* (2013.01); *B65H 19/30* (2013.01); *B65H 2301/41394* (2013.01); *B65H 2301/41858* (2013.01)

(58) Field of Classification Search

CPC .. B65H 19/30; B65H 19/223; B65H 19/2292; B65H 18/021; B65H 18/08

See application file for complete search history.

(56) References Cited

U.S. PATENT DOCUMENTS

| | | | | |
|---|---|---|---|---|
| 9,517,909 | B2 * | 12/2016 | Bauer | B65H 18/08 |
| 11,535,472 | B2 * | 12/2022 | Hernando Saiz | B65H 67/00 |
| 2022/0356041 | A1 * | 11/2022 | Hong | B65H 67/052 |
| 2024/0017950 | A1 * | 1/2024 | Xie | B65H 19/30 |

* cited by examiner

*Primary Examiner* — Sang K Kim

(74) *Attorney, Agent, or Firm* — Barley Snyder

(57) ABSTRACT

A material strip collection mechanism coiling fed material strip on a reel includes a vertically positioned reel bracket rotatable about a vertical axis between a first configuration and a second configuration. The mechanism further includes a first arm holding the reel and a second arm each rotatable to drive the reel and coil the material strip on the reel. With the reel bracket in the first configuration, the first arm is in a material strip collection position to allow the material strip to be coiled on each empty reel held by the first arm to form a full reel, while the second arm is in a standby position to allow the full reel held by the second arm to be replaced with a new empty reel.

20 Claims, 8 Drawing Sheets

MATERIAL STRIP PROCESSING SYSTEM

CROSS-REFERENCE TO RELATED APPLICATIONS

This application claims the benefit of Chinese Patent Application No. CN202110266138.6 filed on Mar. 11, 2021 in the State Intellectual Property Office of China, the whole disclosure of which is incorporated herein by reference.

FIELD OF THE INVENTION

Embodiments of the present disclosure generally relate to a material strip processing system, and more specifically, relate to a material strip processing system capable of collecting a material strip and replacing a reel in a non-shutdown state.

BACKGROUND

In the prior art, product material strips such as stamping material strips are usually coiled on reels to facilitate the storage, transportation, management or application of material strips. During replacement of the reel used for coiling the material strip, stopping the material strip processing system is usually required to unload the full reel with the coiled material strip and load the empty reel without the material strip, to continue receiving and coiling the material strip. The reel replacement can be completed manually or by machine, but the efficiency of manual reel replacement is low. In addition, during replacing the reel by machine, the material strip processing system also needs to be stopped, which affects the work efficiency.

SUMMARY

According to an embodiment of the present disclosure, a material strip collection mechanism coiling fed material strip on a reel includes a vertically positioned reel bracket rotatable about a vertical axis between a first configuration and a second configuration. The mechanism includes a first arm and a second arm each rotatable to drive the reel and coil the material strip on the reel. With the reel bracket in the first configuration, the first arm is in a material strip collection position to allow the material strip to be coiled on each empty reel held by the first arm to form a full reel, while the second arm is in a standby position to allow the full reel held by the second arm to be replaced with a new empty reel.

BRIEF DESCRIPTION OF THE DRAWINGS

The invention will now be described by way of example with reference to the accompanying Figures, of which.

DETAILED DESCRIPTION OF THE EMBODIMENTS

Figure 1:
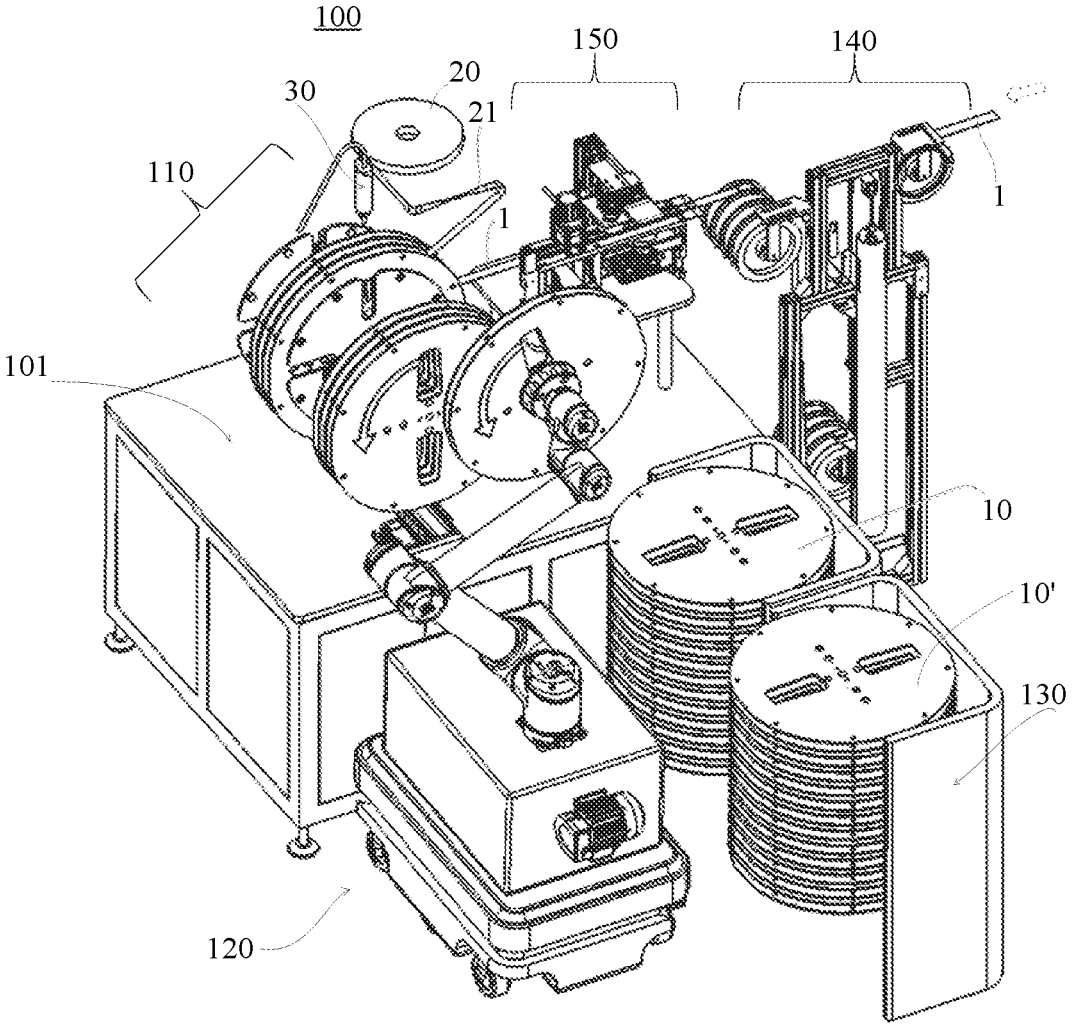
FIG. 1 is an illustrative perspective view of a material strip processing system according to an exemplary embodiment of the present disclosure.

Exemplary embodiments of the present disclosure will be described hereinafter in detail with reference to the attached drawings, wherein the like reference numerals refer to the like elements. The present disclosure may, however, be embodied in many different forms and should not be construed as being limited to the embodiment set forth herein; rather, these embodiments are provided so that the present disclosure will be thorough and complete, and will fully convey the concept of the disclosure to those skilled in the art.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

According to an exemplary embodiment of the present disclosure, a material strip processing system comprises a material strip collection mechanism. The collection mechanism is adapted to coil a fed material strip on a reel. The material strip collection mechanism includes a vertically positioned reel bracket having a first arm and a second arm opposite to the first arm. Each of the first arm and the second arm is configured to hold the reel and is capable of being rotated to drive the reel to rotate with it and coil the material strip on the reel. At least a portion of the reel bracket is configured to be rotated about a vertical axis so that the reel bracket is capable of being converted between a first configuration and a second configuration. When the reel bracket is in the first configuration, the first arm is in a material strip collection position to allow the material strip to be coiled on each empty reel held by the first arm to form a full reel, while the second arm is in a standby position to allow the full reel held by the second arm to be replaced with a new empty reel. Likewise, when the reel bracket is in the second configuration, the second arm is in the material strip collection position to allow the material strip to be coiled on each empty reel held by the second arm to form a new full reel, while the first arm is in the standby position to allow the full reel held by the first arm to be replaced with a new empty reel.

As shown in the figures, according to the exemplary embodiment of the present disclosure, a material strip processing system 100 is provided which can perform a variety of operations on the material strip without shutdown, such as material strip collection (such as coiling), reel replacement, etc., as well as material strip or product inspection, material strip cutting, etc. The material strip can include various forms of product material strips, for example, the stamping material strip, such as the terminal material strip. In other embodiments, a punch or other material strip processing mechanism may also form part of the material strip processing system according to an embodiment of the present disclosure.

In the illustrated embodiment, the material strip processing system 100 includes a material strip collection mechanism 110 for coiling the fed material strip 1 on the reel. As shown in FIGS. 1-6, the material strip collection mechanism 110 can be arranged on an underframe 101 including a reel bracket 111. For example, the reel bracket 111 can be vertically positioned as a whole to support or maintain the empty reel 10 on which the material strip is to be coiled and the full reel 10' on which the material strip has been coiled. For example, the reel bracket 111 may have at least a first arm 1111 and a second arm 1112 separated from each other, such as positioning or extending in opposite directions, such as opposite to each other in the horizontal direction. Each arm can hold one or more empty reels 10 or full reels 10', such as one, two, three or more reels, and each arm can hold the reels in such a way that the reels (e.g., in the horizontal direction) overlap each other (e.g., the end faces of the reels are against each other). For example, each arm may pass through the axial hole of the reel so that the reel is supported and/or maintained on the arm. Each arm can rotate (e.g., driven by the driving mechanism) to drive the reel to rotate, so as to coil the material strip on the reel. As shown in the figure, the reel has a roll 11 and end plates 12 located at opposite ends of the roll 11, and a slot for coiling the material strip is defined between the end plates 12. The reels held on each arm can be overlapped with each other in the axial direction of the reel in such a way that the adjacent end plates 12 are butted against each other.

According to an exemplary embodiment, at least a portion of the reel bracket 111 is arranged to be rotatable, such as about a vertical axis, so that the reel bracket 111 can be converted between a first configuration and a second configuration, that is, switched to the first configuration or the second configuration, so that the first arm 1111 and the second arm 1112 exchange positions with each other. In the first configuration, the first arm 1111 is in the material strip collection position and the second arm 1112 is in the standby position, so as to allow the material strip to be coiled on each empty reel 10 supported and rotated by the first arm 1111 to form a full reel and allow the full reel 10' held by the second arm 1112 to be replaced with a new empty reel; In the second configuration, the positions of the first arm 1111 and the second arm 1112 are interchanged by rotation, so that the second arm 1112 is in the material strip collection position to allow the material strip to be coiled on each empty reel 10 held and rotated by the second arm 1112 to form a new full reel. At the same time, the first arm 1111 is in the standby position to allow a new empty reel to replace the full reel 10' held by the first arm 1111.

With this material strip collection mechanism, the material strip can be coiled on the empty reel held by the arm on one side of the material strip collection mechanism (such as the side close to the fed material strip or the inner side), and the full reel held by the arm on the other side of the material strip collection mechanism (such as the side away from the fed material strip or the outer side) can be replaced with a new empty reel. Therefore, the material strip collection and reel replacement can be carried out at the same time without mutual interference, so as to improve the work efficiency. Only through the rotation of the reel bracket, the material strip collection and reel replacement can be quickly changed. This kind of conversion time is short, and almost continuous material strip collection can be realized. Furthermore, the shutdown of the press or the interruption of the feeding of the material strip in the prior art can be avoided.

In some embodiments, as shown in FIGS. 2 and 4-6, the reel bracket 111 includes a base 1113 and a rotating member 1114, for example, in the form of a column. The rotating member 1114 is rotatably mounted on the base 1113 and is capable of being rotated around a vertical axis. The first arm 1111 and the second arm 1112 may be located on opposite sides of the top of the rotating member 1114. For example, the first arm 1111 and the second arm 1112 form a roughly T-shaped profile with the rotating member 1114. In other embodiments, the entire reel bracket is rotatable, or alternatively, only the first arm and the second arm can exchange positions with each other. The empty reel 10 held by the first arm 1111 or the second arm 1112 in the material strip collection position can be driven to rotate at a rotation speed corresponding to the material strip feed speed.

In the embodiment shown in FIGS. 1-6, each of the first arm 1111 and the second arm 1112 is provided with a rotatable first support plate 113, and each first support plate 113 is oriented towards the reel 10 or 10' held by the corresponding arm for engaging the reel closest to the first support plate during the coiling of the material strip, for example, the first support plate may include a suction cup for adsorbing the reel, a protrusion engaged with the reel, etc. In some examples, the rotation of the first support plate 113 can drive the reel at the material strip collection position to rotate. For example, it can drive at least the empty reel 10 at the material strip collection position to coil the material strip 1 on the empty reel. In other examples, the first arm 1111 and the second arm 1112 in the material strip collection position may be driven to rotate to drive the held reel and/or the first support plate 113 to rotate together.

Figure 4:
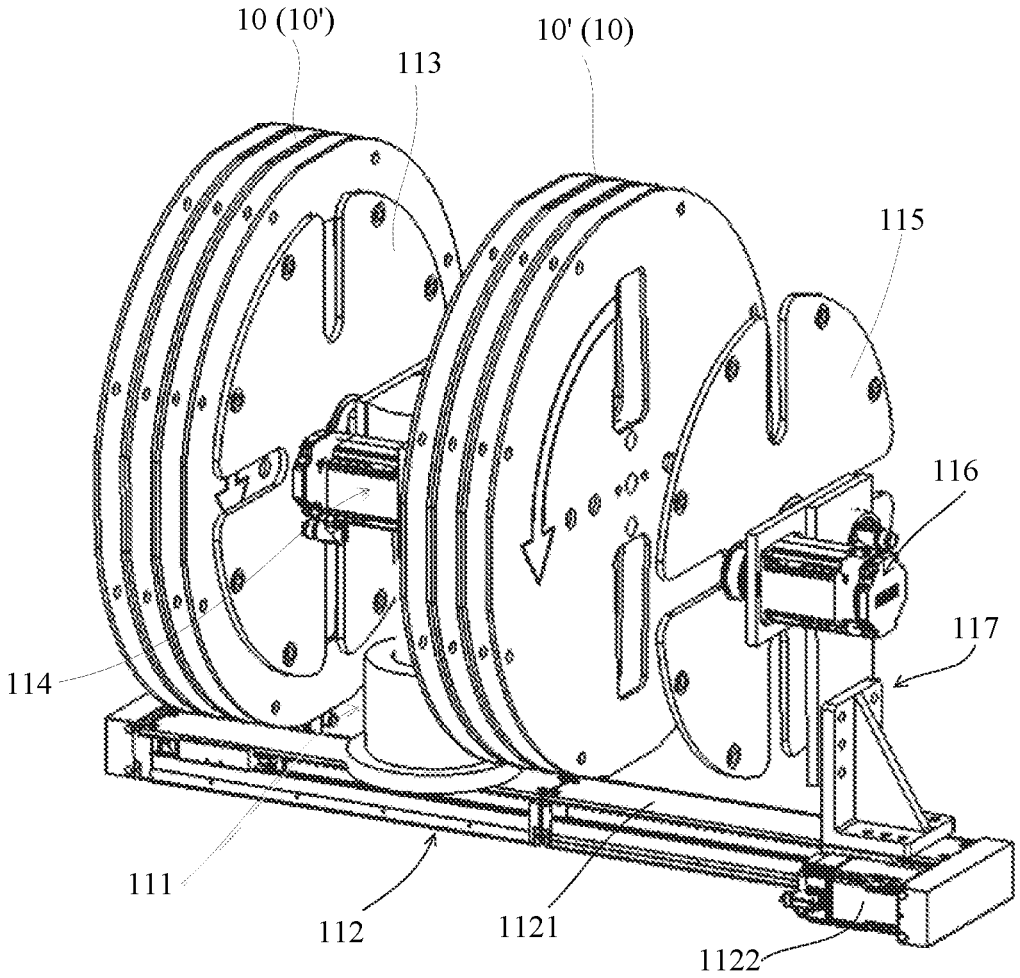
FIG. 4 is a side perspective view schematically showing a material strip collection mechanism of a material strip processing system according to an exemplary embodiment of the present disclosure.
Figure 5:
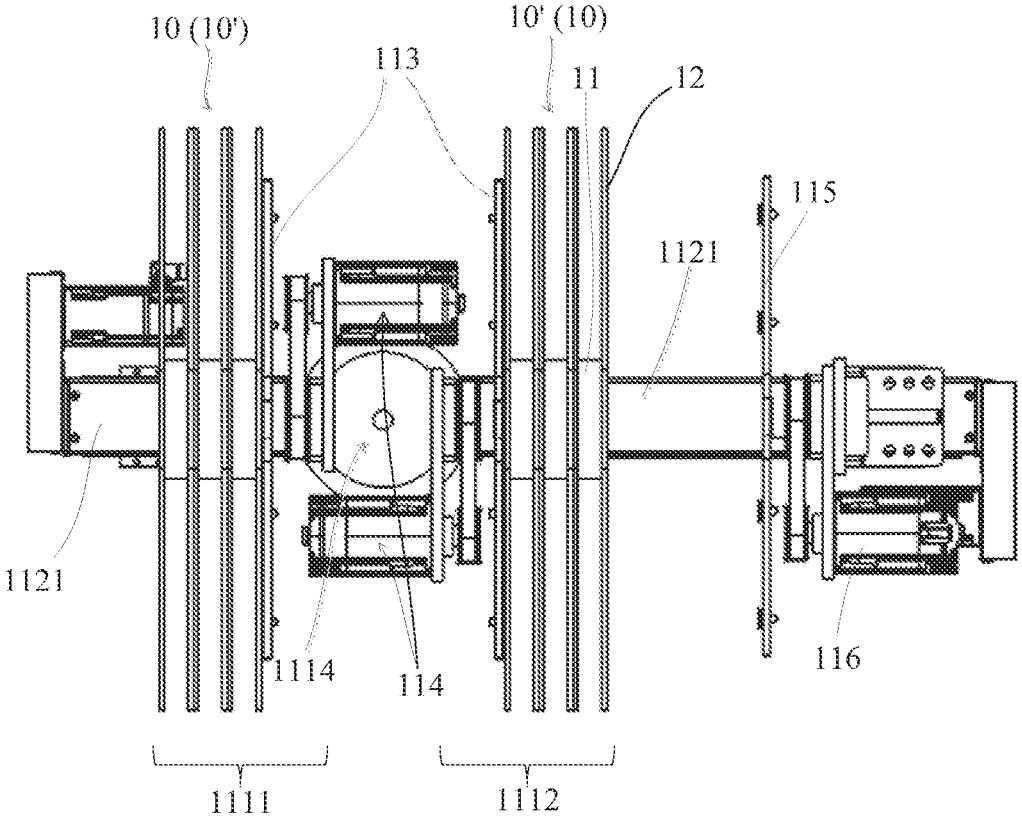
FIG. 5 is a top view schematically showing a material strip collection mechanism of a material strip processing system according to an exemplary embodiment of the present disclosure.
Figure 6:
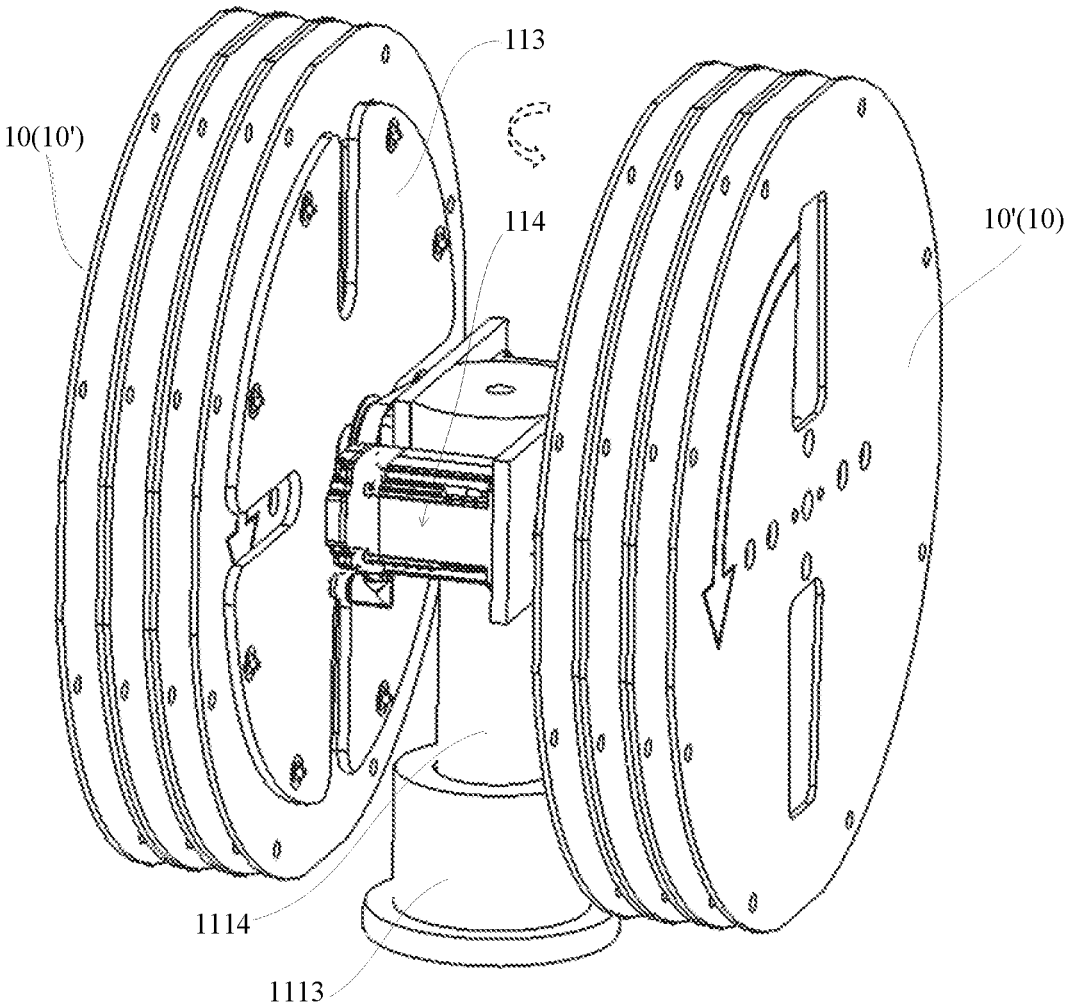
FIG. 6 is a perspective view schematically showing a reel bracket of a material strip collection mechanism of a material strip processing system according to an exemplary embodiment of the present disclosure and a reel held on the reel bracket.
Figure 7:
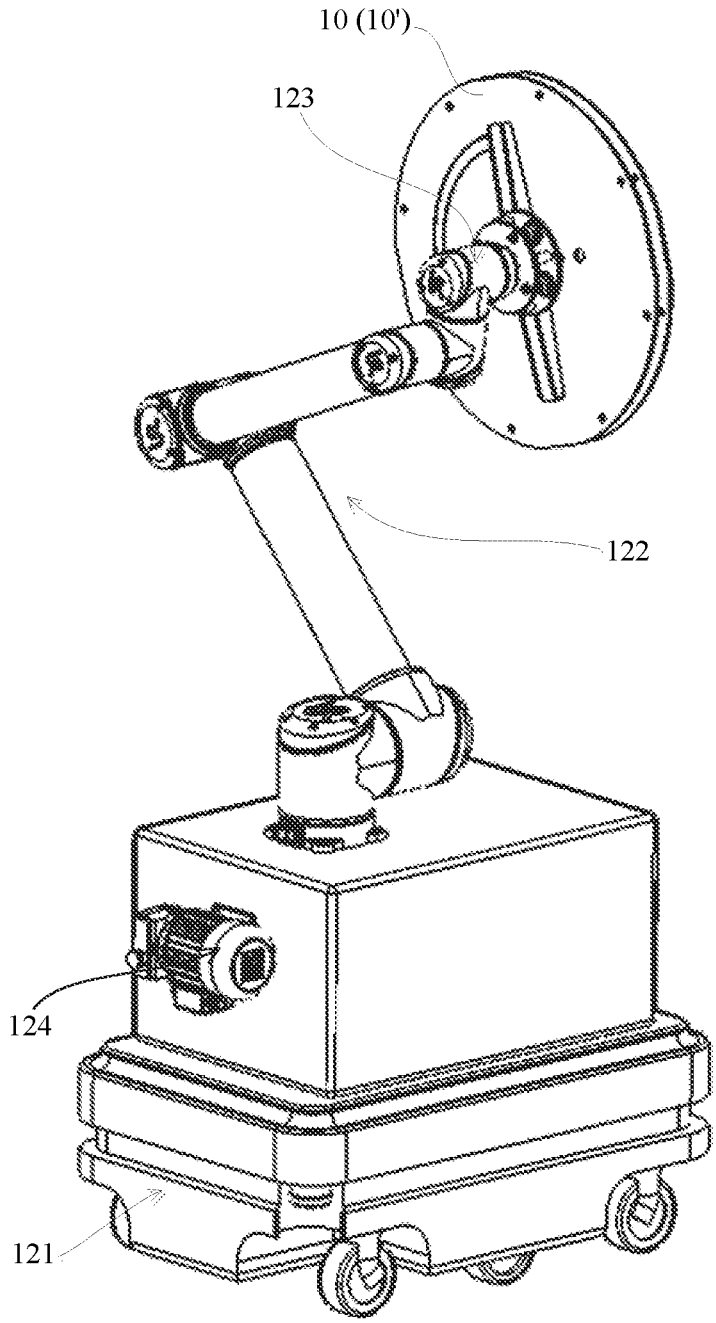
FIG. 7 is a perspective view schematically showing a reel replacement system of a material strip processing system according to an exemplary embodiment of the present disclosure.
Figure 8:
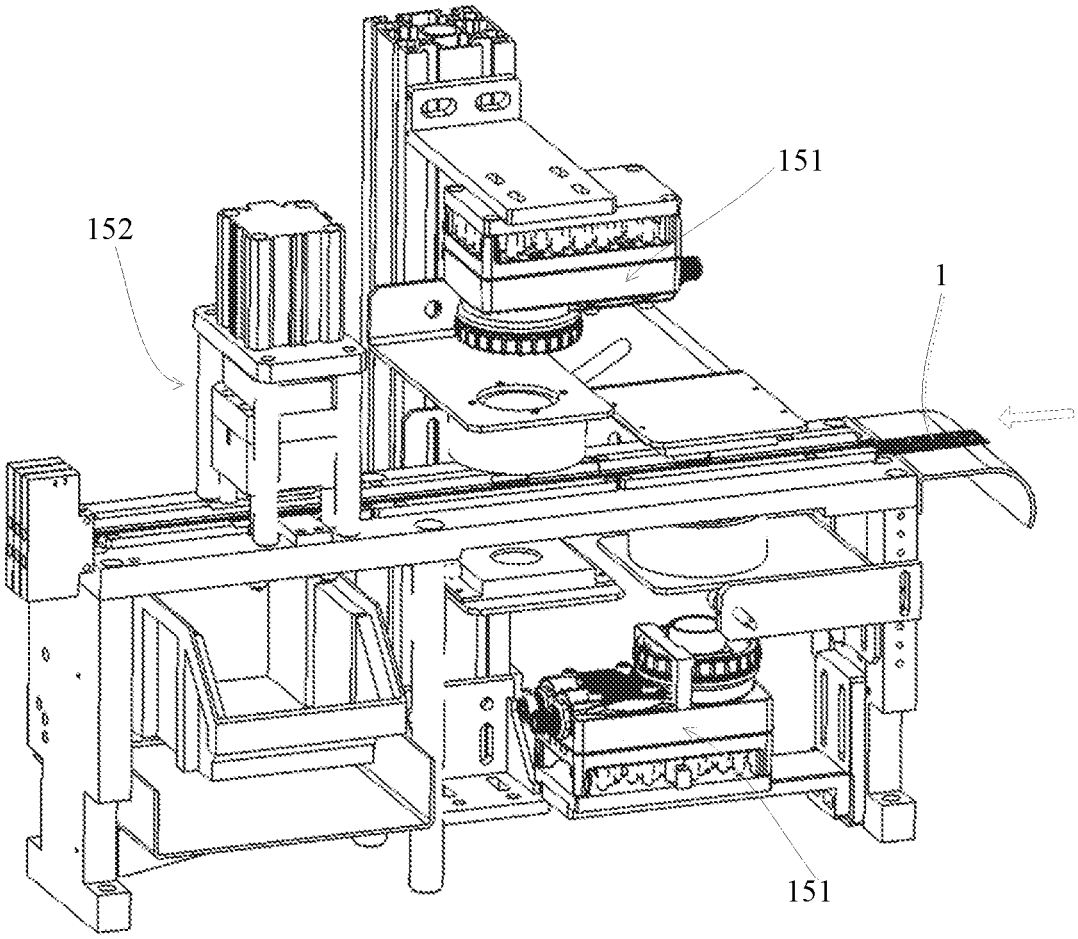
FIG. 8 is a perspective view schematically showing a material strip inspection and cutting system of a material strip processing system according to an exemplary embodiment of the present disclosure.

As an example, as shown in FIGS. 4-6, the material strip collection mechanism 110 may also include a first driving device 114, such as a motor, which is used to drive the arm 1111 or 1112 at the material strip collection position and/or the first support plate 113 on it to rotate, so as to drive the held reel to rotate, so that the fed material strip 1 is coiled on the empty reel 10.

In the illustrated embodiment, the material strip collection mechanism 110 also includes a rotatable second support plate 115, which is positioned opposite to the first support plate 113 on one of the first arm 1111 and the second arm 1112 in the material strip collection position, so as to press the reel held by the arm in the material strip collection position against the first support plate 1113 during the coiling of the material strip. It can avoid the shaking of the reel during rotation, so that the material strip can be coiled stably. After all empty reels held by the arm at the material strip collection position are fully coiled with the material strip, the second support plate 115 and the first support plate 113 can be disengaged from these full reels to facilitate the replacement of these full reels.

Figure 2:
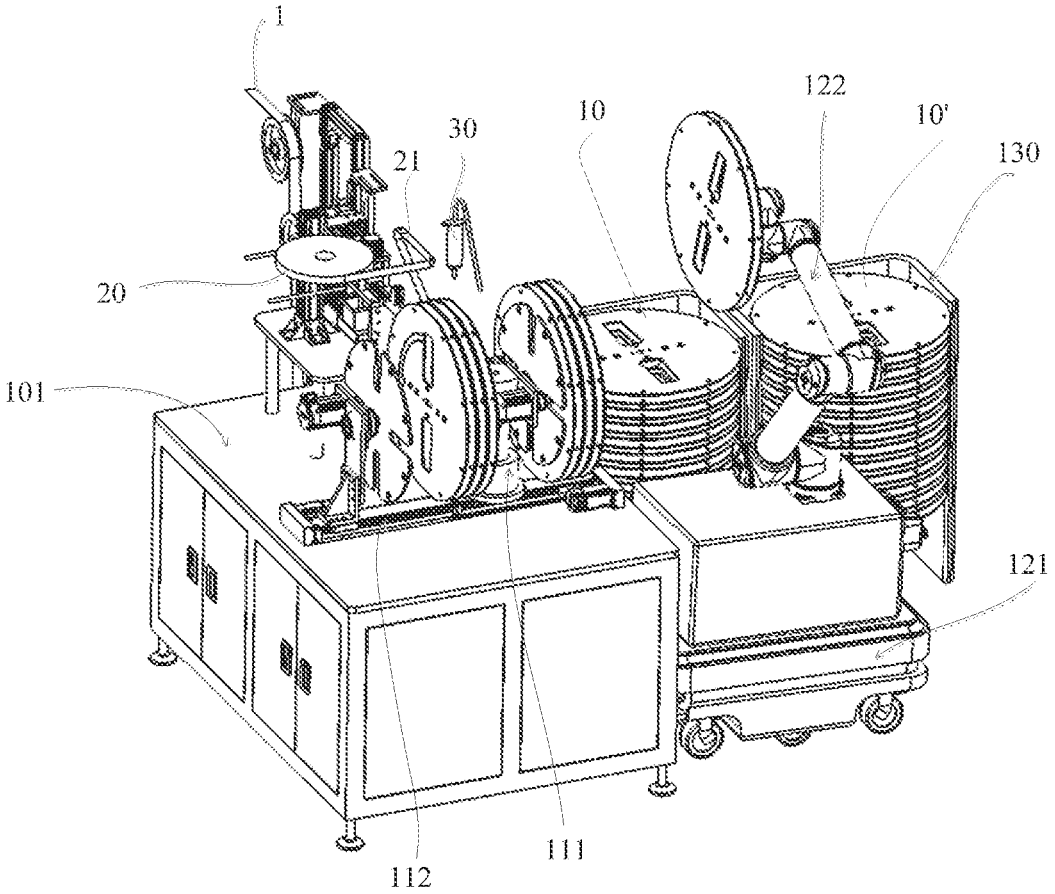
FIG. 2 is a side perspective view schematically showing a material strip processing system according to an exemplary embodiment of the present disclosure.

As shown in FIGS. 2, 4 and 5, the material strip collection mechanism 110 may also include a second driving device 116 and a support 117. The second driving device 116 and the second support plate 115 are installed on the support 117. The second driving device 116 is, for example, a motor, which can drive the second support plate 115 to rotate at a rotation speed corresponding to the material strip feed speed during the coiling of the material strip. The support 117 and the reel bracket 111 can be moved relative to each other so that the second support plate 115 can engage to or disengage from the reel held by the arm of the reel bracket 111.

In some embodiments, as shown in FIGS. 1-5, the material strip collection mechanism 110 may also include a guide mechanism 112, and the reel bracket 111 is movably mounted on the guide mechanism 112 and can be driven to move along the guide mechanism 112, so that the empty reel 10 which is held by the first arm 1111 or the second arm 1112 in the material strip collection position and on which the material strip is to be coiled is aligned with the fed material strip 1. For example, after an empty reel 10 held by the first arm 1111 or the second arm 1112 in the material strip collection position is fully coiled with the material strip to become the full reel 10', the reel bracket 111 can be guided to move by the guide mechanism 112, so that the other empty reel 10 held by the first arm 1111 or the second arm 1112 at the material strip collection position is aligned with the fed material strip 1, and the coiling of the material strip is continued.

For example, the guide mechanism 112 may include a guide rail 1121 and a third driving device 1122, such as a motor, which can be used to drive the reel bracket 111 to move along the guide rail 1121. For example, the base 1113 of the reel bracket 111 is movably arranged on the guide rail 1121, and the third driving device 1122 can drive the base 1113 to move along the guide rail 1121 directly or through a transmission mechanism such as chain, material strip or rack, so as to adjust the position of the reel held by the reel bracket 111 and its arm. In addition, in some examples, the support 117 may also be movably mounted on the guide mechanism 112 or its guide rail 1121, and the support 117 may be driven to move by the third driving device 1122 or another driving device.

In some embodiments, the material strip processing system 100 also includes a reel replacement system 120, which can be used to unload at least the full reel 10' held by the arm of the first arm 1111 and the second arm 1112 in the standby position, and load a new empty reel on the arm in the standby position. For example, a reel storage mechanism 130 may be provided near the material strip collection mechanism 110, in which the replaced full reel 10' and/or a spare new empty reel 10 can be stored.

In an exemplary embodiment, the reel replacement system 120 includes a movable carrier 121 and a robot operation arm 122, which is carried on the movable carrier to replace the reel. For example, the end of the robot operation arm 122 is provided with a clamping tool 123 for clamping and removing the full reel 10' held by the arm in the standby position of the reel bracket 111 and placing it in the reel storage mechanism 130, and clamping a new empty reel 10 from the reel storage mechanism 130 to load it onto the arm in the standby position of the reel bracket 111. As an example, the clamping tool 123 may be provided with a suction cup to suck the reel, and a suction force for sucking the reel may be provided to the suction cup through a vacuum pump 124.

In some examples, the movable carrier may include an automatic guided vehicle (AGV) suitable for autonomous movement between a plurality of material strip processing systems or material strip collection mechanisms in a workplace (such as a factory) for reel replacement by a robot operation arm 122 mounted thereon. The movable carrier itself can also be provided with a space suitable for storing empty reels and full reels.

Figure 3:
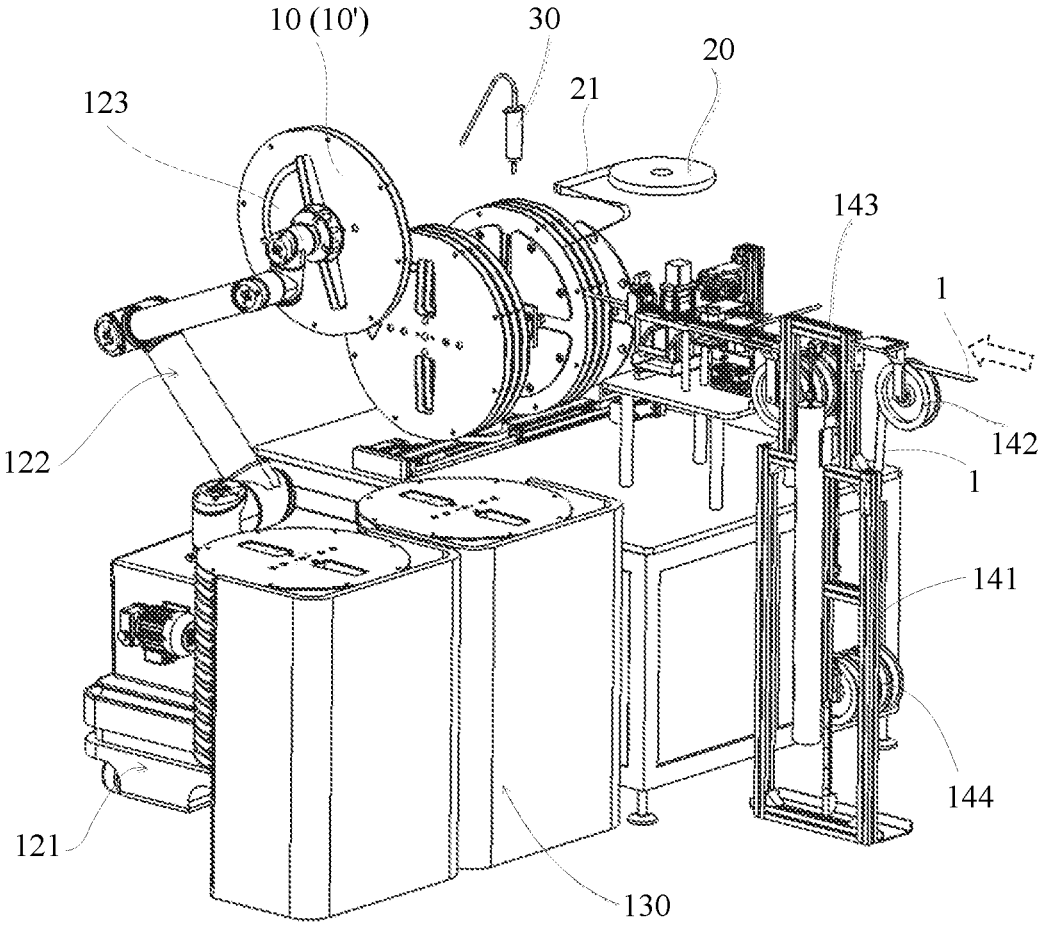
FIG. 3 is another side perspective view schematically showing a material strip processing system according to an exemplary embodiment of the present disclosure.

In some embodiments, as shown in FIGS. 1-3, the material strip processing system 100 also includes a material strip buffer mechanism 140, which is arranged upstream of the material strip collection mechanism 120 along the material strip feeding direction to buffer a predetermined length of material strip, so that the continuously fed material strip can be temporarily stored in the material strip buffer mechanism within a short time when the material strip collection mechanism is switched (e.g. rotated), there is no need to interrupt the feeding of the material strip and/or stop the press for stamping the material strip.

As an example, as shown in the figure, the material strip buffer mechanism 140 may include a frame 141, a first fixed roller 142 and a second fixed roller 143 installed on the frame 141, and a movable roller 144 located between the first fixed roller 142 and the second fixed roller 143. The material strip 1 is fed around the first fixed roller 142, the movable roller 144 and the second fixed roller 143 in turn. The movable roller 144 is suspended between the first fixed roller 142 and the second fixed roller 143 in a manner that can move up and down through the material strip 1, so that the length of the material strip coiled or extended between the first fixed roller 142, the movable roller 144 and the second fixed roller 143 can be changed to realize the cushioning of the material strip.

As shown in FIGS. 1-3 and 8, the material strip processing system 100 may also include a material strip inspection and cutting system 150 arranged upstream of the material strip collection mechanism 120 along the material strip feeding direction, such as between the material strip buffer mechanism 140 and the material strip collection mechanism 120. The material strip inspection and cutting system 150 may include a camera 151 for inspecting the material strip or the products carried by it (such as terminals) before collecting or coiling the material strip 1. After the reels held by the arm of the reel bracket 111 at the material strip collection position are fully coiled with the material strip to become a full reel 10'. The material strip can be cut off by the cutting mechanism 152 of the material strip inspection and cutting system 150. The reel bracket 111 switches the first configuration and the second configuration, and then the coiling of the material strip is continued.

In the illustrated embodiment, as shown in FIGS. 1-3, the material strip processing system 100 also includes a glue coating tool 30, which can apply glue on the roll 11 of the empty reel 10 before starting to coil the material strip on the empty reel 10, so as to adhere the front end of the fed material strip 1 to the roll 11, and then coil the material strip on the reel. In some examples, the material strip processing system 100 may also be configured with a paper tape roll 20 for supplying the paper tape 21. For example, before coiling the material strip on the empty reel 10, the glue coating tool 30 applies glue on the roll 11 of the empty reel 10, pastes the paper tape 21 on the roll 11 of the empty reel 10, then applies glue on the paper tape 21, and adheres the front end of the fed material strip 1 to the paper tape 21 on the roll 11; Then, the paper tape 21 starts coiling on the reel together with the material tape 1, so that there is a paper tape 21 between the layers of the material tape coiled on the reel to isolate and/or insulate the layers of the material tape; After the coiling is completed, the paper tape 21 and the material tape 1 are cut off, and the glue application tool 30 applies glue to adhere the paper tape 21 to the end of the material tape 1, so that the material tape coiled on the reel can be restrained and fixed. The paper tape can also be replaced by other suitable insulation tape.

In addition, those areas in which it is believed that those of ordinary skill in the art are familiar, have not been described herein in order not to unnecessarily obscure the invention described. Accordingly, it has to be understood that the invention is not to be limited by the specific illustrative embodiments, but only by the scope of the appended claims.

It should be appreciated for those skilled in this art that the above embodiments are intended to be illustrated, and not restrictive. For example, many modifications may be made to the above embodiments by those skilled in this art, and various features described in different embodiments may be freely combined with each other without conflicting in configuration or principle.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

As used herein, an element recited in the singular and proceeded with the word "a" or "an" should be understood as not excluding plural of the elements or steps, unless such exclusion is explicitly stated. Furthermore, references to "one embodiment" of the present disclosure are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

What is claimed is:

1. A material strip processing system, comprising:

a material strip collection mechanism coiling a material strip on a reel, including:

a vertically positioned reel bracket rotatable about a vertical axis between a first configuration and a second configuration, and having:

a first arm holding the reel and rotatable to drive the reel and coil the material strip on the reel; and a second arm opposite to the first arm, the second arm holding the reel and rotatable to drive the reel and coil the material strip on the reel, with the reel bracket in the first configuration, the first arm is in a material strip collection position to allow the material strip to be coiled on each empty reel held by the first arm to form a full reel, while the second arm is in a standby position to allow the full reel held by the second arm to be replaced with a new empty reel;

with the reel bracket in the second configuration, the second arm is in the material strip collection position to allow the material strip to be coiled on each empty reel held by the second arm to form a new full reel, while the first arm is in the standby position to allow the full reel held by the first arm to be replaced with a new empty reel; and wherein the first arm or the second arm in the material strip collection position holds and drives the empty reel to rotate at a rotation speed corresponding to a feed speed of the material strip.

2. The material strip processing system according to claim 1, wherein the reel bracket includes a base and a rotating member rotatably mounted on the base about the vertical axis.

3. The material strip processing system according to claim 2, wherein the first arm and the second arm are located on respective opposite sides of a top end of the rotating member.

4. The material strip processing system according to claim 1, wherein each of the first arm and the second arm includes a first support plate that is rotatable and oriented towards the reel.

5. The material strip processing system according to claim 4, wherein each first support plate engages the reel closest to the first support plate during coiling of the material strip, so as to drive the empty reel in the material strip collection position to rotate and coil the material strip on the empty reel.

6. The material strip processing system according to claim 5, wherein the material strip collection mechanism further includes a first driving device driving one of the first arm and the second arm at the material strip collection position and/or the first support plate on it to rotate, so that the empty reel at the material strip collection position is driven to rotate and the material strip is coiled on the empty reel.

7. The material strip processing system according to claim 5, wherein the material strip collection mechanism further includes a rotatable second support plate positioned opposite to the first support plate on one of the first arm and the second arm in the material strip collection position.

8. The material strip processing system according to claim 7, wherein the rotatable second support plate presses the reel held by the one of the first arm and the second arm in the material strip collection position against the first support plate during the coiling of the material strip.

9. The material strip processing system according to claim 8, wherein the material strip collection mechanism further includes a second driving device, the second driving device driving the second support plate to rotate at a rotation speed corresponding to the feed speed of the material strip during the coiling of the material strip.

10. The material strip processing system according to claim 9, wherein the material strip collection mechanism further includes a support on which the second driving device and the second support plate are mounted.

11. The material strip processing system according to claim 1, wherein the reel bracket is movably mounted on a guide mechanism of the material strip collection mechanism.

12. The material strip processing system according to claim 11, wherein the guide mechanism includes a guide rail and a third driving device driving the reel bracket to move along the guide rail.

13. The material strip processing system according to claim 1, further comprising a reel replacement system adapted to unload the full reel held by one of the first arm and the second arm in the standby position and load a new empty reel on the one arm in the standby position.

14. The material strip processing system according to claim 13, wherein the reel replacement system includes a movable carrier and a robot operation arm mounted on the movable carrier and configured to replace the reel.

15. The material strip processing system according to claim 14, wherein the movable carrier includes an autonomous guided vehicle guiding movement between a plurality of material strip processing systems in a workplace.

16. The material strip processing system according to claim 14, wherein the movable carrier includes a space sized for storing the empty reel and the full reel.

17. A material strip processing system, comprising:

a material strip collection mechanism coiling a material strip on a reel, including:

a vertically positioned reel bracket rotatable about a vertical axis between a first configuration and a second configuration, and having:

a first arm holding the reel and rotatable to drive the reel and coil the material strip on the reel; and a second arm opposite to the first arm, the second arm holding the reel and rotatable to drive the reel and coil the material strip on the reel, with the reel bracket in the first configuration, the first arm is in a material strip collection position to allow the material strip to be coiled on each empty reel held by the first arm to form a full reel, while the second arm is in a standby position to allow the full reel held by the second arm to be replaced with a new empty reel; and with the reel bracket in the second configuration, the second arm is in the material strip collection position to allow the material strip to be coiled on each empty reel held by the second arm to form a new full reel, while the first arm is in the standby position to allow the full reel held by the first arm to be replaced with a new empty reel; and a material strip buffer mechanism arranged upstream of the material strip collection mechanism along a feed direction of the material strip for buffering a predetermined length of material strip.

18. The material strip processing system according to claim 17, wherein the material strip buffer mechanism includes a frame, a first fixed roller and a second fixed roller installed on the frame.

19. The material strip processing system according to claim 18, wherein the material strip buffer mechanism further includes a movable roller located between the first fixed roller and the second fixed roller.

20. A material strip processing system, comprising:

a material strip collection mechanism coiling a material strip on a reel, including:

a vertically positioned reel bracket rotatable about a vertical axis between a first configuration and a second configuration, and having:

a first arm holding the reel and rotatable to drive the reel and coil the material strip on the reel; and a second arm opposite to the first arm, the second arm holding the reel and rotatable to drive the reel and coil the material strip on the reel, with the reel bracket in the first configuration, the first arm is in a material strip collection position to allow the material strip to be coiled on each empty reel held by the first arm to form a full reel, while the second arm is in a standby position to allow the full reel held by the second arm to be replaced with a new empty reel; and with the reel bracket in the second configuration, the second arm is in the material strip collection position to allow the material strip to be coiled on each empty reel held by the second arm to form a new full reel, while the first arm is in the standby position to allow the full reel held by the first arm to be replaced with a new empty reel; and a guide mechanism including a driving device and a guide rail, the reel bracket mounted on the guide rail and driven to move along the guide rail by the driving device.

* * * * *